US007137320B2

(12) United States Patent
Tuan-Mu

(10) Patent No.: US 7,137,320 B2
(45) Date of Patent: Nov. 21, 2006

(54) RATCHETING TOOL DRIVER

(75) Inventor: Hsien-Chung Tuan-Mu, Taichung (TW)

(73) Assignee: Easco Hand Tools, Inc., Simsbury, CT (US)

( * ) Notice: Subject to any disclaimer, the term of this patent is extended or adjusted under 35 U.S.C. 154(b) by 0 days.

(21) Appl. No.: 10/360,180

(22) Filed: Feb. 7, 2003

(65) Prior Publication Data

US 2004/0154439 A1 Aug. 12, 2004

(51) Int. Cl.
*B25B 13/46* (2006.01)
*B25B 15/04* (2006.01)

(52) U.S. Cl. ..... 81/63.1; 81/58.4; 192/43.2

(58) Field of Classification Search ..... 81/60–63.1, 81/58.4; 192/43.1, 43.2, 44, 45, 43.44
See application file for complete search history.

(56) References Cited

U.S. PATENT DOCUMENTS

| | | | | |
|---|---|---|---|---|
| 791,895 | A | 6/1905 | Purbish | |
| 1,493,353 | A | 5/1924 | Leopold | |
| 2,627,330 | A | 2/1953 | Gantz | |
| 2,720,296 | A | 10/1955 | Briglia | |
| 3,342,229 | A | 9/1967 | Janes | |
| 3,356,117 | A | 12/1967 | Wagner | |
| 3,783,703 | A | 1/1974 | Trimble et al. | |
| 4,290,328 | A | 9/1981 | Clark | |
| 4,735,120 | A | 4/1988 | Beugelsdyk | |
| 5,437,212 | A | 8/1995 | Thomson et al. | |
| 5,520,073 | A | 5/1996 | Bakula et al. | |
| 5,535,648 | A * | 7/1996 | Braun et al. | 81/63.1 |
| 5,570,616 | A | 11/1996 | Thompson et al. | |
| 5,575,192 | A | 11/1996 | Eggert | |
| 5,685,204 | A * | 11/1997 | Braun | 81/63.1 |
| 5,687,820 | A * | 11/1997 | Lin | 81/63.1 |
| 5,711,193 | A | 1/1998 | Eggert | |
| 5,974,915 | A * | 11/1999 | Chou | 81/63.1 |
| 5,988,337 | A * | 11/1999 | Liu | 192/43.1 |
| 6,047,802 | A * | 4/2000 | Huang | 192/43.2 |
| 6,227,077 | B1 | 5/2001 | Chiang | |
| 6,250,183 | B1 | 6/2001 | Chiang | |
| 6,370,988 | B1 | 4/2002 | Thompson et al. | |
| 6,644,147 | B1 * | 11/2003 | Huang | 81/62 |

FOREIGN PATENT DOCUMENTS

| | | |
|---|---|---|
| DE | 9208547 | 10/1992 |
| DE | 9318291 | 4/1994 |
| GB | 2145359 | 3/1985 |

* cited by examiner

*Primary Examiner*—Hadi Shakeri
(74) *Attorney, Agent, or Firm*—Nelson Mullins Riley & Scarborough, L.L.P.

(57) ABSTRACT

A ratcheting tool driver has a handle and a ratcheting body that includes a plurality of recesses for receiving a plurality of pawls having teeth formed thereon. A cover is axially secured to the ratcheting body and rotates relative to the body over a limited distance. The cover is formed so that it interacts with the plurality of pawls, which are operatively received in the body recesses so that they engage and disengage teeth formed on a socket ring. The socket ring contains a plurality of teeth on its outer circumference, is received in an axial bore formed in the ratcheting body, and operatively engages the pawl teeth.

32 Claims, 10 Drawing Sheets

RATCHETING TOOL DRIVER

BACKGROUND OF THE INVENTION

The present invention relates to drivers for interchangeable driver bits and, in particular, to drivers of the ratcheting type.

Ratcheting drivers are well known, as are drivers with interchangeable bits. Conventional ratchet mechanisms for ratcheting screwdrivers, for example, have pawls that extend in the axial direction defined by the screwdriver shaft and that have narrow extensions engageable with teeth of a gear provided on the shaft. The pawls are pushed into and out of engagement with the gear by a control member that is usually slidable in the axial direction. Such ratchet mechanisms occupy a significant proportion of the overall length of the screwdriver.

One type of ratcheting driver for interchangeable bits is disclosed in U.S. Pat. No. 4,777,852. That patent discloses a ratcheting arrangement wherein a ratchet body is press-fitted into a recess in one end of a handle and a cap telescopes over the body for rotation with respect thereto. The force transmission from the cap to the pawl assembly is indirect and involves a multi-part assembly.

SUMMARY OF THE INVENTION

The present invention recognizes and addresses considerations of prior art constructions and methods. In an embodiment of the present invention a ratcheting tool driver has a hand-actuatable body defining a first axial bore, an end face transverse to the first axial bore, and a first chamber recessed from and opening into the end face and the first axial bore. A socket ring disposed in, and rotatable about an axis of, said first axial bore defines 1) teeth about an outer circumference thereof, and 2) a second axial bore that receives a tool shank in rotationally driving engagement therein. A first pawl having at least one pawl tooth is disposed in the first chamber so that the first pawl is slidable transversely to the first axial bore between 1) a first pawl first position in which the at least one first pawl tooth engages the socket ring teeth so that the first pawl blocks relative rotation between the body and the socket ring in a first rotational direction, and 2) a first pawl second position in which the first pawl tooth is disengaged from the socket ring teeth, wherein the first pawl is biased toward the first pawl first position.

In one embodiment, the tool driver further includes a second pawl having at least one tooth. The first pawl and the second pawl are slidably disposed in the first chamber so that the second pawl is slidable parallel to the first pawl between 1) a second pawl first position in which the second pawl tooth engages the socket ring teeth so that the second pawl blocks relative rotation between the body and the socket ring in a second rotational direction, and 2) a second pawl second position in which the second pawl tooth is disengaged from the socket ring teeth. The second pawl is biased toward the second pawl first position by a spring disposed between the first pawl and the second pawl.

In another embodiment, the tool driver further includes a second chamber recessed from and opening into the end face and the first axial bore, and a second pawl having at least one pawl tooth, wherein the second pawl is disposed in the second chamber so that the second pawl is slidable transversely to the first axial bore between 1) a second pawl first position in which the second pawl tooth engages the socket ring teeth so that said second pawl blocks relative rotation between the body and the socket ring in a second rotational direction opposite the first rotational direction, and 2) a second pawl second position in which the second pawl tooth is disengaged from the socket ring teeth. A spring biases the second pawl toward the second pawl first position.

The first chamber and the second chamber are elongated and parallel to each other. However, the first chamber and the second chamber may be disposed at the same acute angle with respect to a plane between the first chamber and the second chamber that includes the central axis of said axial bore. The acute angle is between zero degrees and less than or equal to ten degrees, and in a preferred embodiment, the angle is five degrees.

Either of the two above described embodiments include a cam attached to and selectively movable with respect to the body so that it moves the first pawl between the first pawl first and second position and the second pawl between the second pawl first and second position. The cam may be a hand-actuable annular cover that defines a cam surface on an inner circumference thereof. A detent defined between the annular cover and the body retains the cam in a first cam position and a second cam position.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 7C:
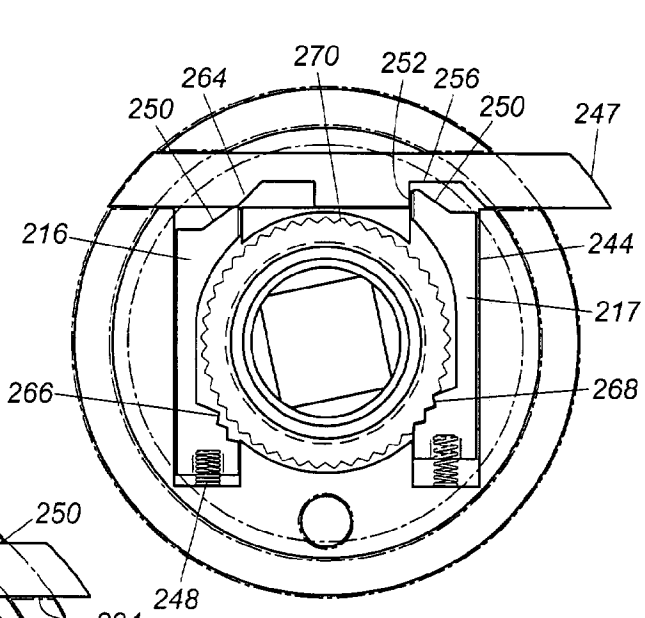
Figure 7B:
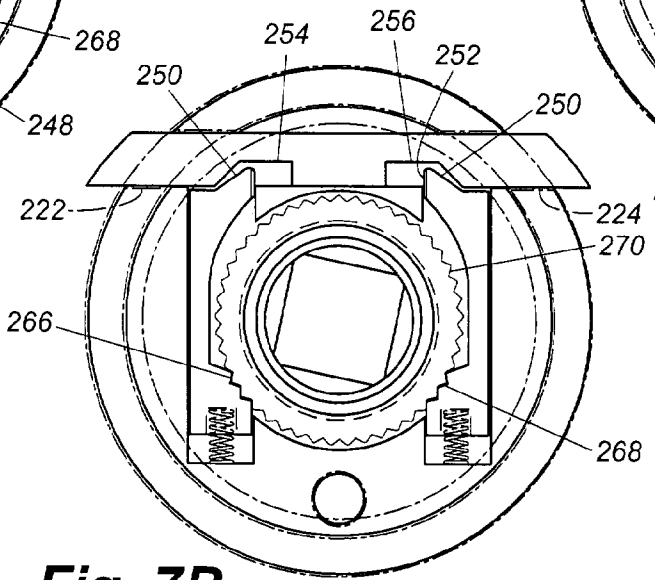
Figure 7A:
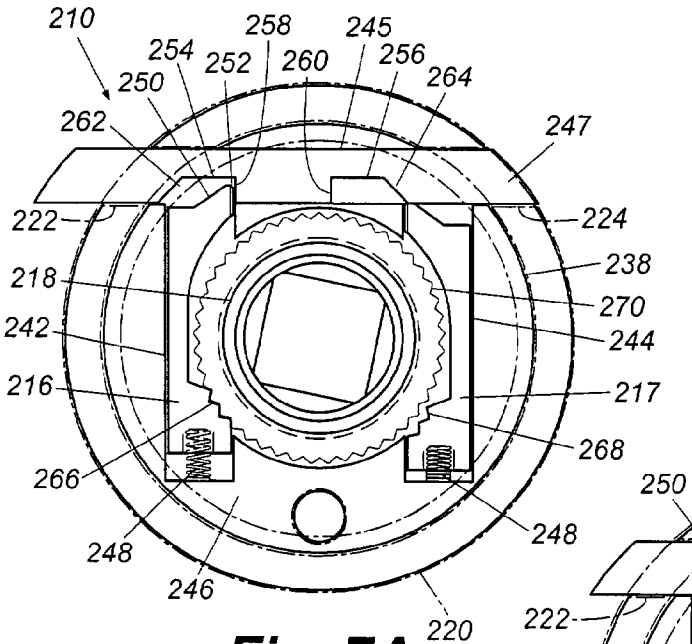
Figure 8C:
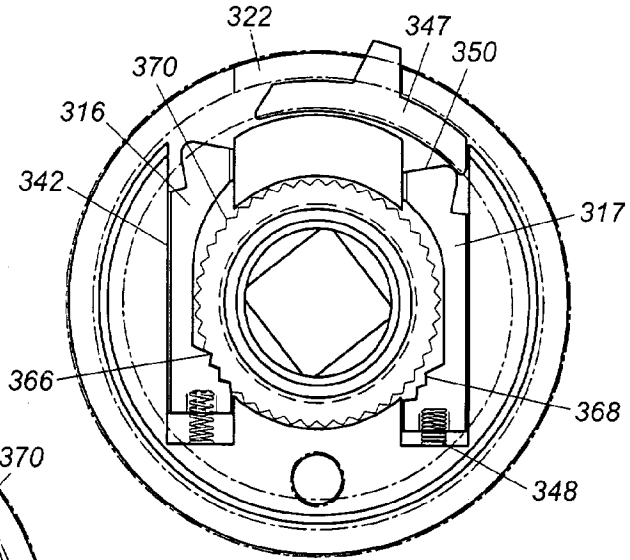
Figure 8B:
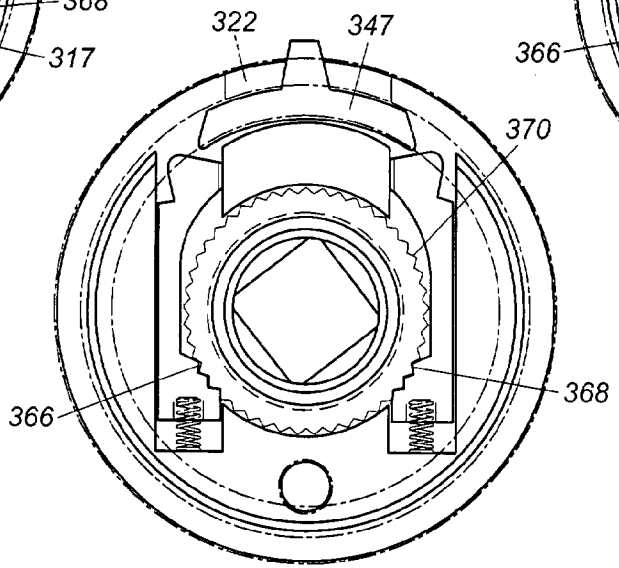
Figure 8A:
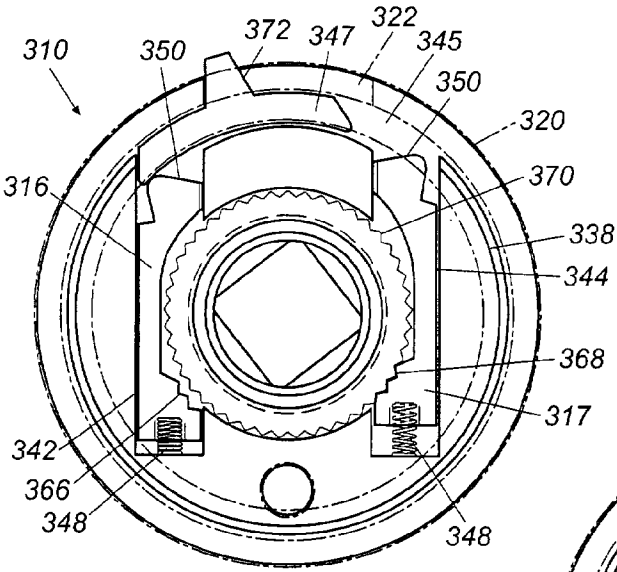
Figure 10C:
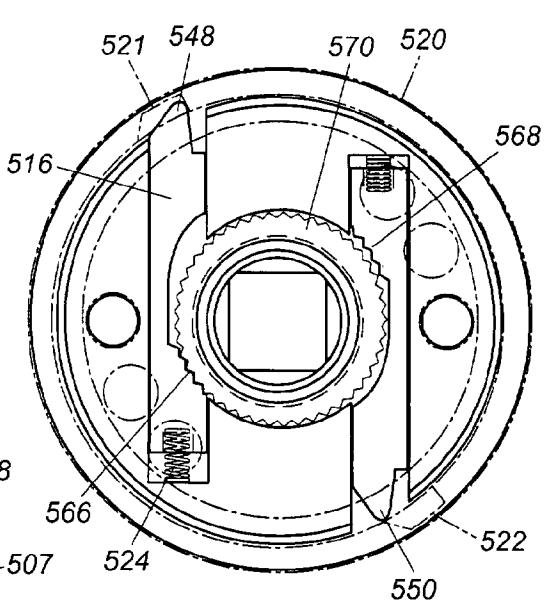
Figure 10B:
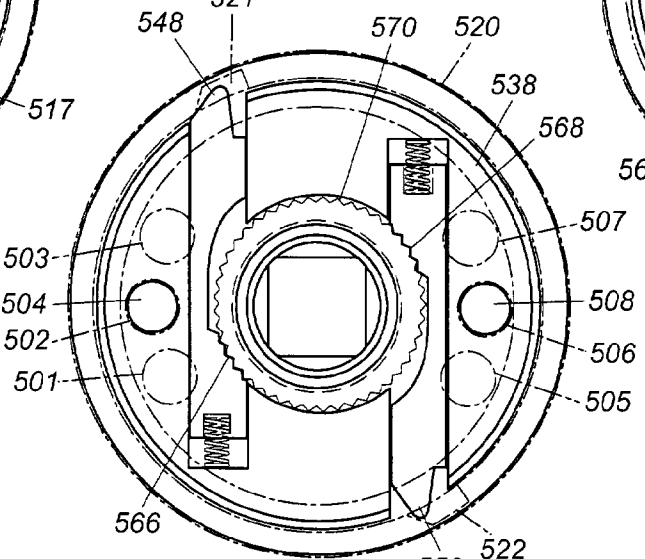
Figure 10A:
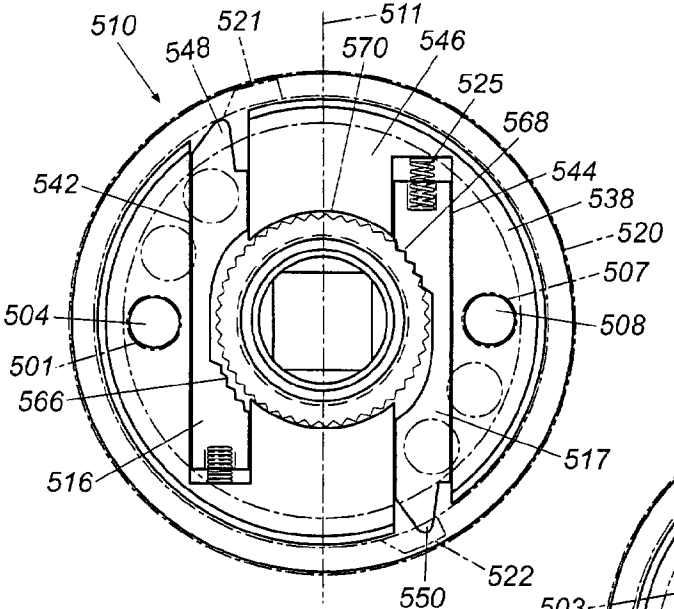
Figure 1:
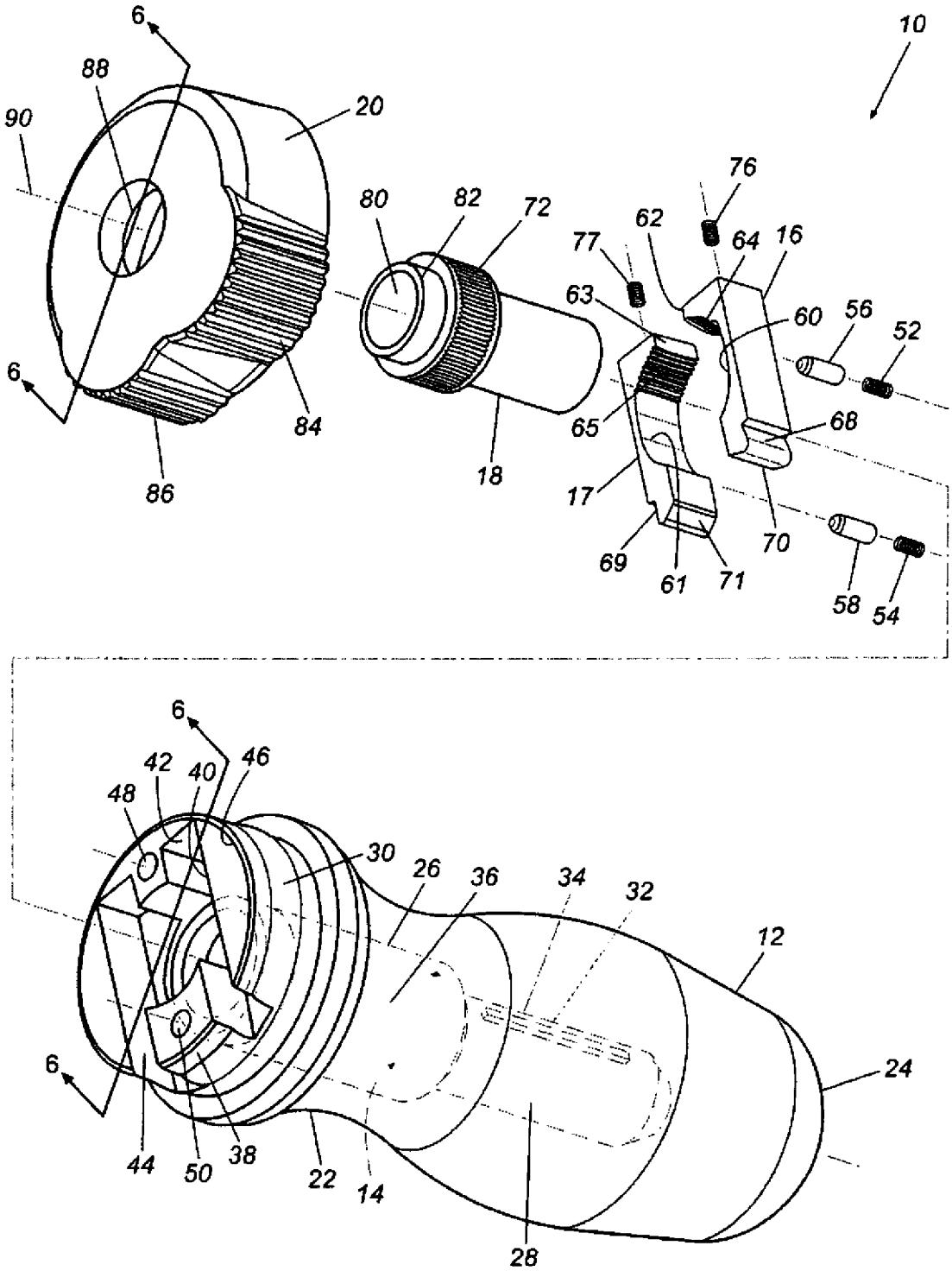
Figure 6:
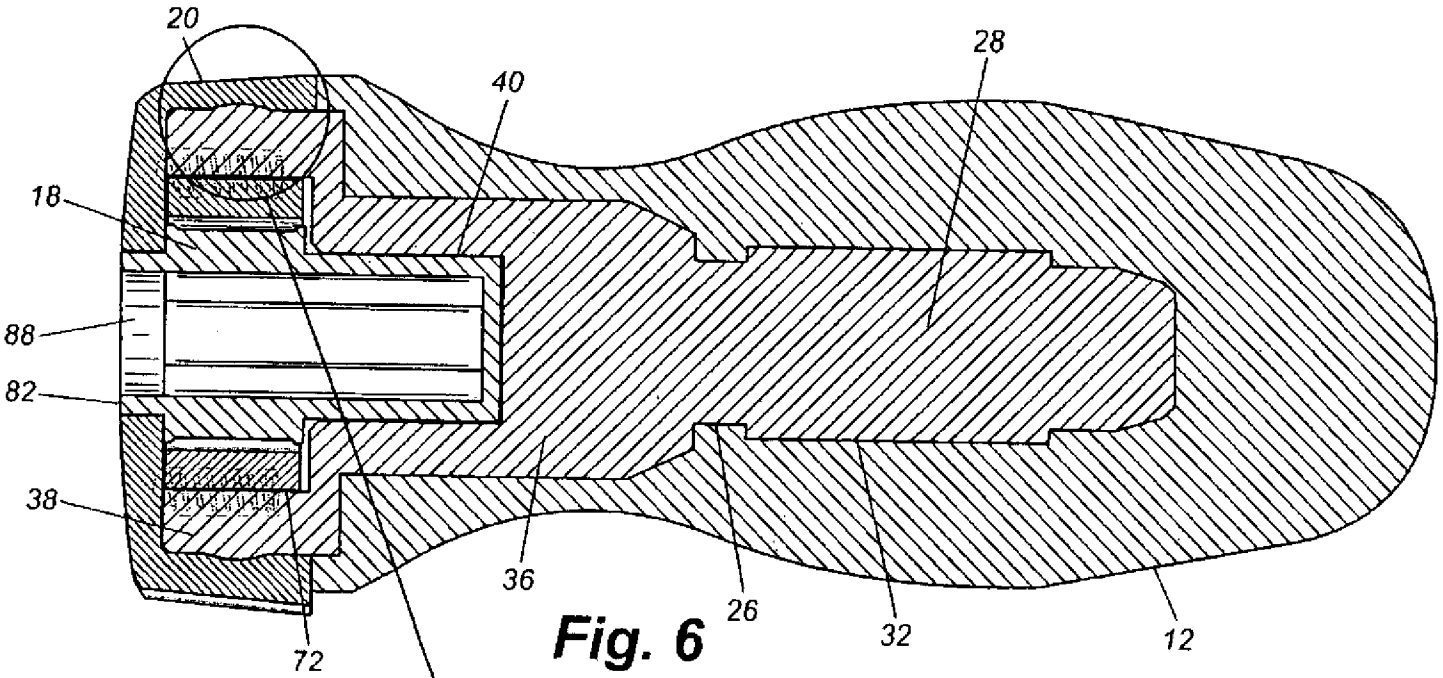
Figure 6B:
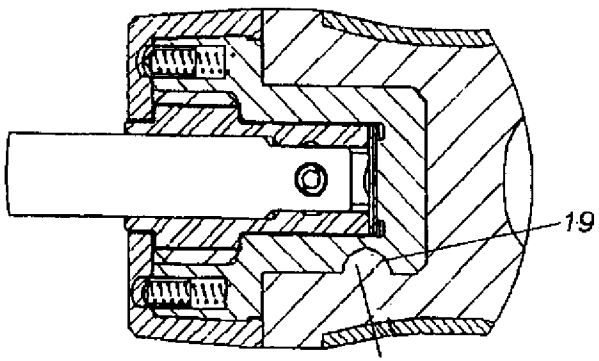
Figure 6A:
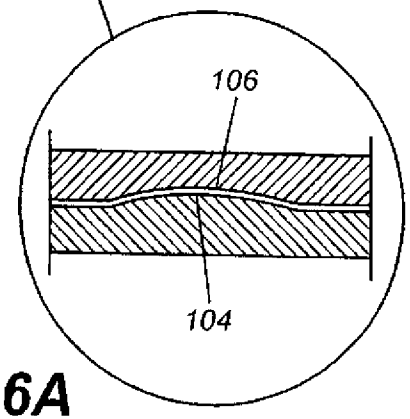

Each of FIGS. 7A–7C is a top view, partly in section, of the ratcheting tool in accordance with an embodiment of the present invention;

Each of FIGS. 8A–8C is a top view, partly in section, of the ratcheting tool in accordance with an embodiment of the present invention;

Each of FIGS. 9A–9D is a top view, partly in section, of the ratcheting tool in accordance with an embodiment of the present invention;

Each of FIGS. 10A–10C is a top view, partly in section, of the ratcheting tool in accordance with an embodiment of the present invention;

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1:
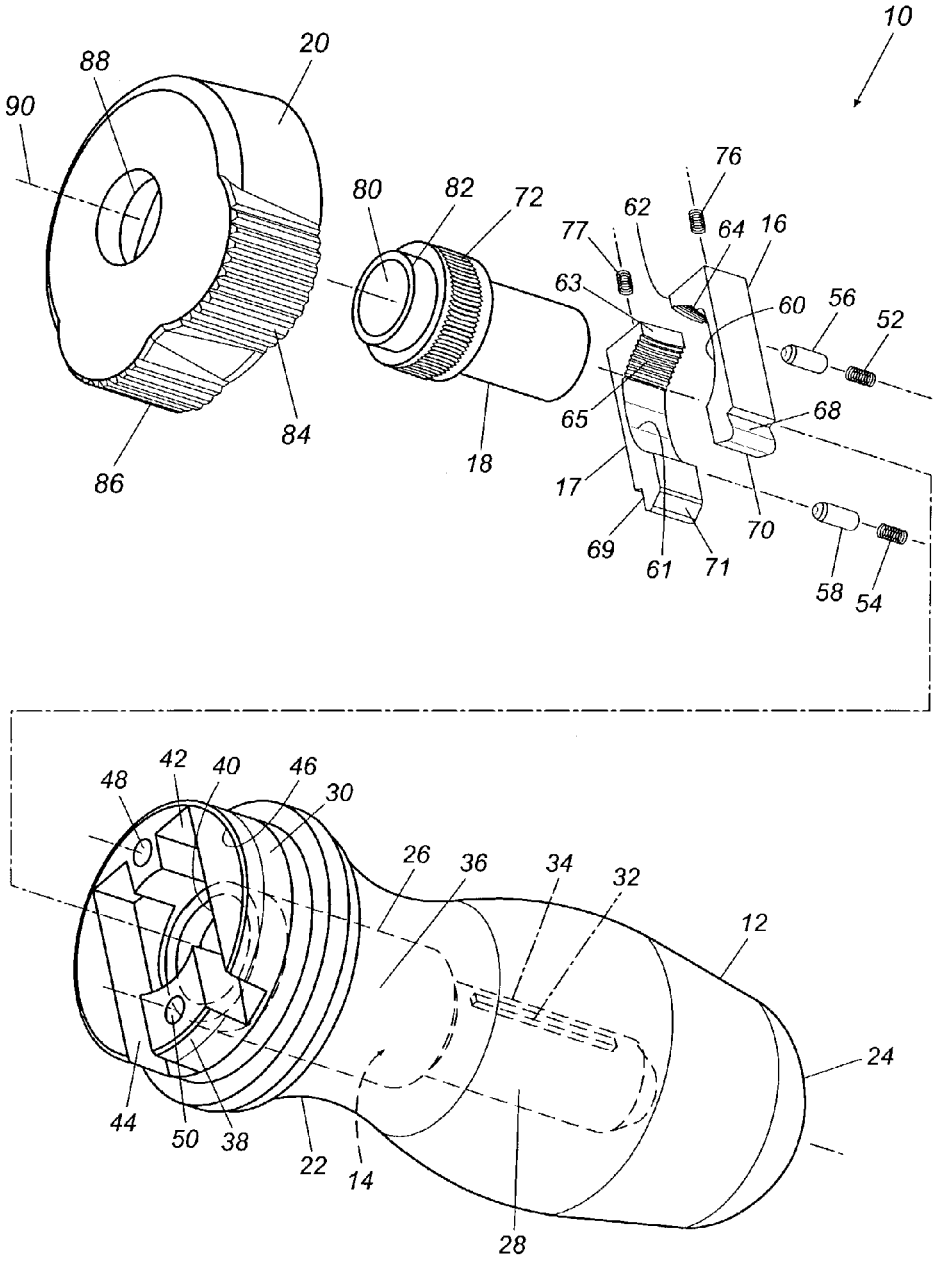
FIG. 1 is an exploded view of a ratcheting tool in accordance with an embodiment of the present invention.
Figures 6, 6A, 6B:
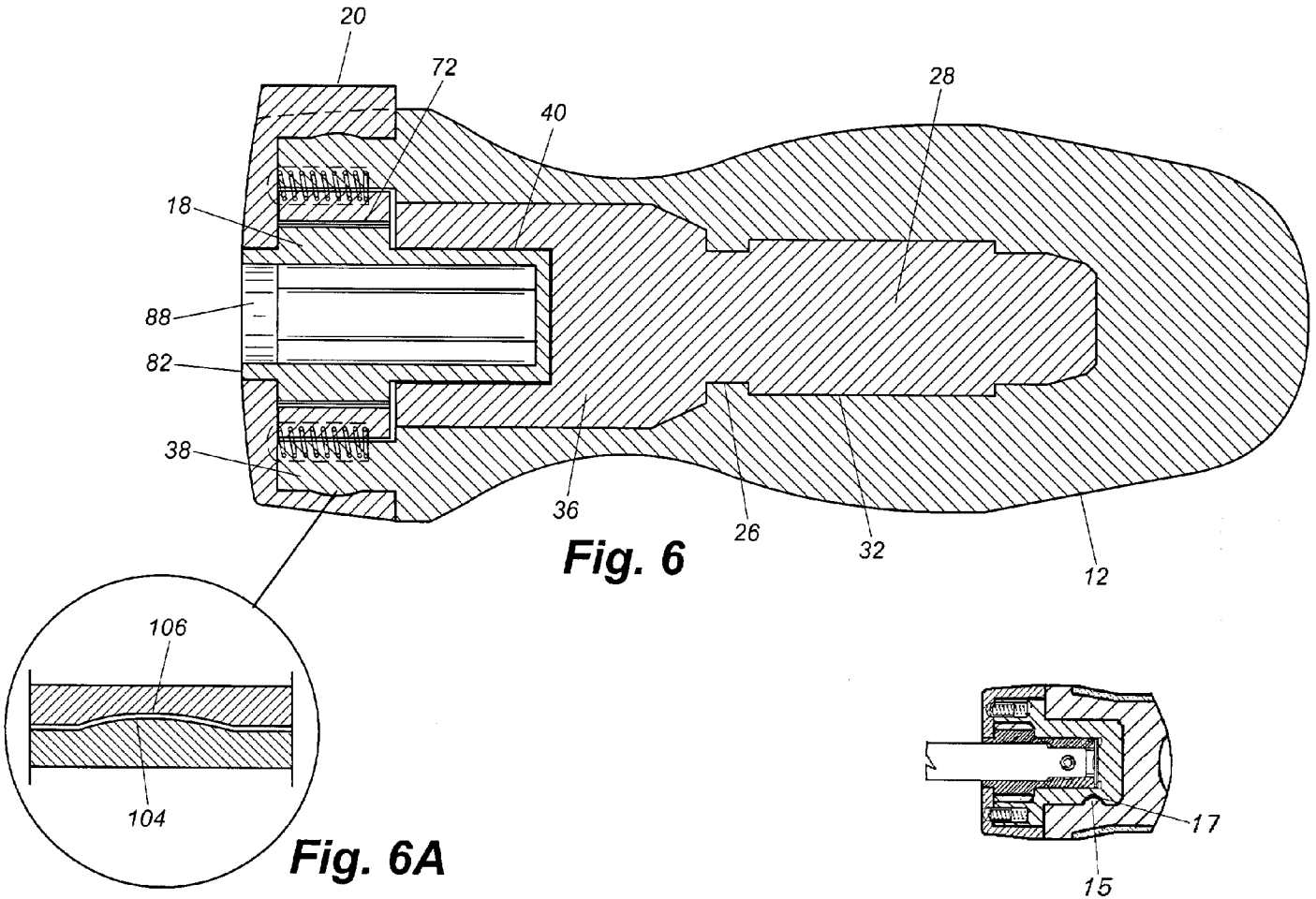
FIG. 6 is a partial sectional view of the ratcheting tool as in FIG. 1.
FIG. 6A is a detail cutaway view of the handle and cover of the ratcheting tool as in FIG. 1.
FIG. 6B is a detail cutaway view of a ratcheting tool handle in accordance with an embodiment of the present invention.

FIGS. 1 and 6 show a ratcheting driver, in this instance a screwdriver, 10 in accordance with an embodiment of the present invention. Driver 10 includes a handle 12, a body 14, pawls 16 and 17, a socket ring 18, and a cover 20. Handle 12 is generally cylindrical in shape and includes a first end 22 and a second end 24. First end 22 defines an axial bore 26 of a size and shape to receive body 14. The exterior shape of handle 12 may vary as desired, and the handle may be formed from any suitable material including, but not limited to, wood, metal or metal alloy, ceramic, rubber or a polymer. Handle 12 may be knurled and/or may include a polymer or rubber coating around its periphery to increase the effectiveness of a user's grasp.

Body 14 comprises a cylindrical shank portion 28 and a ratcheting body 30. Shank portion 28 may contain one or more ribs or splines 32 that are received in respective corresponding axial grooves 34 to thereby rotationally lock handle 12 to body 14. Other methods may be implemented to rotationally lock handle 12 to shank portion 28. For example, body 14 may be press fit into handle 12, or shank portion 28 may contain flat surfaces (not shown) that mate with corresponding flat surfaces formed on the inner diameter of bore 26 to thereby rotationally lock handle 12 to shank 28. Handle 12 may be axially locked to body 14 through frictional force, adhesive, or as shown in FIG. 6B, by a flange 15 and recess 19.

Ratcheting body 30 includes a cylindrical portion 36 and an annular portion 38 that may be integrally formed with cylindrical portion 36. Body 14 may be formed from any suitable material such as stainless steel, alloys or other metals and, in a preferred embodiment, is formed from zinc alloy. Annular portion 38 and cylindrical portion 36 define an axial bore 40 adapted to receive socket ring 18. A front face 46 of annular portion 38 also defines two blind axial bores 48 and 50 that receive respective sets of springs 52 and 54 and pins 56 and 58. Other detent means may be used instead of a spring/pin set, for example a spring-loaded lever or ball, a clip spring, a nylon spring, or a self contained spring and plunger unit.

Figure 2C:
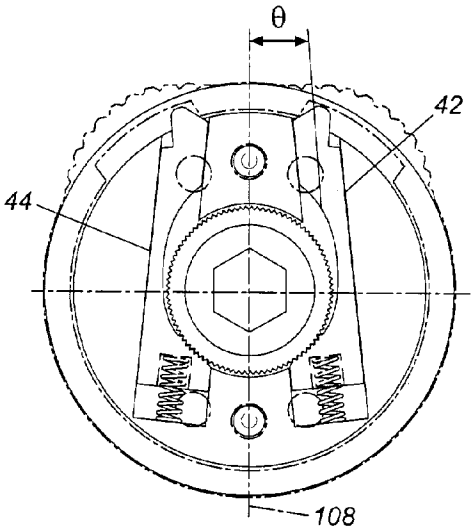
FIG. 2C is a top sectional view of a ratcheting tool in accordance with an embodiment of the present invention.
Figure 2B:
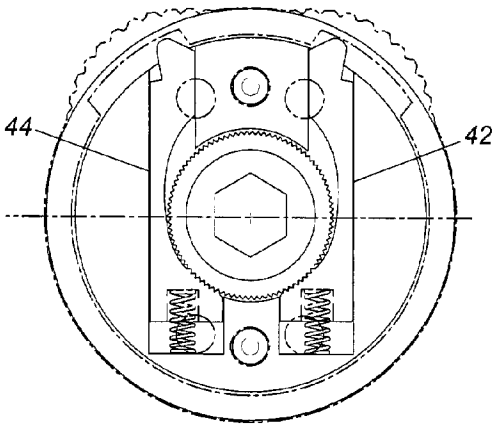
FIG. 2B is a top sectional view of the ratcheting tool as in FIG. 1.
Figure 2A:
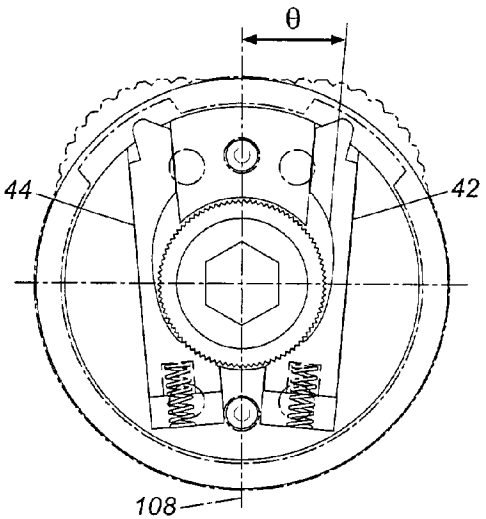
FIG. 2A is a top sectional view of a ratcheting tool in accordance with an embodiment of the present invention

Annular portion 38 defines two recessed chambers 42 and 44 that are recessed from and open into annular portion front face 46 and that receive pawls 16 and 17, respectively. Because the chambers open into the front face, pawls 16 and 17 may be placed during the driver's manufacture through the open front face 46. Chambers 42 and 44 are closed at one transverse end but open at the other. Referring also to FIGS. 2A to 2C, recessed chambers 42 and 44 may be parallel to each other, or they may diverge or converge at an angle $\theta$ from a plane 108 that includes the driver's center line 90 (FIG. 1). The angle $\theta$ may be within a range of about 0 to 10 degrees, and in a preferred embodiment angle $\theta$ is 5 degrees. Recessed chambers 42 and 44 are generally rectangular in shape but may also be formed in other shapes corresponding to the shape of pawls 16 and 17.

Returning again to FIG. 1, pawls 16 and 17 are generally rectangular but may be formed in any suitable shape. Pawl ends 70 and 71 form notches 68 and 69, and arches 60 and 61 formed on the pawls' inner sides 62 and 63 have first ends that define respective sets of teeth 64 and 65 that correspond in shape and size to teeth 72 formed on the outer periphery of socket ring 18. Teeth 64 and 65 are defined on an arc having a radius that corresponds to the radius of the gear ring 18 so that the teeth on the pawls fit snugly with the teeth on the gear ring.

Figure 3A:
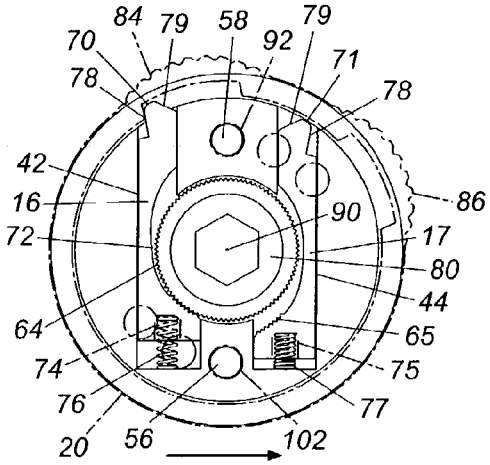
FIG. 3A is a top sectional view of the ratcheting tool as in FIG. 2B.

Referring also to FIG. 3A, blind bores 74 and 75 formed in pawls 16 and 17, respectively, receive springs 76 and 77 that bias pawls 16 and 17 in the outward direction from recesses 42 and 44 so that pawl teeth 64 and 65 are biased toward socket ring teeth 72. Each of notches 68 and 69 defines a stopper face 78 and a slider face 79. Stopper face 78 and slider face 79 engage cover 20 during the operation of driver 10, as explained in detail below.

Socket ring 18 is generally cylindrical in shape with an axial bore 80 formed in one end. Axial bore 80 is polygonal in cross-section to receive a polygonal-shaped tool shaft. It should be understood that axial bore 80 may be configured in any suitable shape, for example in an oval, square, rectangular or TORX cross-section, to receive and rotationally lock a suitable tool shaft to socket ring 18. Socket ring teeth 72 are shaped to match pawl teeth 64 and 65. An annular end portion 82 (FIG. 6) extends through a hole 88 in cover 20 when cover 20 is secured to the body's annular portion 38.

The number of teeth on gear ring 18 may increase or decrease depending on the desired rotational resolution and torque loading requirements. That is, a larger number of teeth on the gear ring and pawl results in a higher rotational resolution. Torque loading, however, is lowered in that the increased number of teeth results in smaller teeth that are more susceptible to slippage. The opposite is true for a lower number of teeth. That is, when the number of teeth are reduced and tooth size is increased, torque loading increases since the pawl teeth are less likely to slip over the socket ring teeth. However, larger teeth result in lower resolution. Therefore, the driver's use will determine the proper balance between rotational resolution and torque loading and, in turn, the number of teeth and tooth size. Tooth size, shape and density are uniform on both the socket ring and the pawl so that the pawl teeth mesh with the socket ring teeth.

Cover 20 is generally cylindrical in shape and includes two outwardly extending knurled thumb grip portions 84 and 86, each of which defines a cavity (FIG. 3) in the cover's inner circumference. Depending on the cover's rotational position with respect to the body, the cavities respectively receive one or both pawl ends 70 and 71. When pawl ends 70 and/or 71 are received in the cavities, springs 76 and/or 77 push the pawl(s) so that pawl teeth 64 and/or 65 engage socket ring teeth 72. Through-hole 88 in cover 20, centered about a longitudinal axis 90 (FIG. 1), receives axial extending portion 82 of socket ring 18 (FIG. 6). As shown in FIGS. 3A to 3E, two sets of three blind bores 92/94/96 and 98/100/102 formed in the underside of cover 20 engage pins 56 and 58 when cover 20 is rotated with respect to the body about longitudinal axis 90.

Referring to FIGS. 6 and 6A, an annular flange 104 formed on the outer circumference of ratcheting body 30 is received in a recess 106 formed on the inner circumference of cover 20, thereby securing the cover to ratcheting body 30. Flange 104 and recess 106 are circumferentially continuous to allow cover 20 to rotate relative to the ratcheting body. However, a partial flange and recess may also be used, provided they axially secure the cover to the ratcheting body while allowing limited relative rotation between the two components.

In operation, driver 10 applies torque to a tool shaft when a user turns handle 12 in a first direction and/or an opposite second direction. Driver 10 may also ratchet with respect to the tool shaft in either direction, depending on the position of cover 20 with respect to body 14. FIG. 3A shows cover 20 positioned so that bores 92 and 102 align with and receive pins 58 and 56, respectively. Spring 76 biases pawl 16 upward so that pawl end 70 enters the cavity defined by thumb grip 84 and pawl teeth 64 engage socket ring teeth 72. A cam surface defined between the cavities formed by thumb grips 84 and 86 push pawl 17 in against the force of spring 77 so that pawl teeth 65 are disengaged from socket ring teeth 72. When a user applies torque to handle 12 in the counterclockwise direction (from the perspective shown in FIG. 3A) while the socket ring is rotationally fixed to a work piece, socket ring teeth 72 apply a clockwise reaction force to pawl teeth 64. This wedges the pawl between the socket ring and the back surface of pawl chamber 42, and torque is thereby applied to the work piece in the counterclockwise direction from body 14 through the pawl and the socket ring.

If, however, the user rotates handle 12 in the clockwise direction when socket ring 18 is rotationally fixed to the work piece, the reaction force causes pawl 16 to push against the bias of spring 76. This compresses spring 76, and pawl teeth 64 eventually ride over socket ring teeth 72. Spring 76 then pushes pawl 16 upward, forcing pawl teeth 64 back into the next set of socket ring teeth. The ratcheting process repeats as the operator continues to rotate handle 12 in the clockwise direction.

Figure 3B:
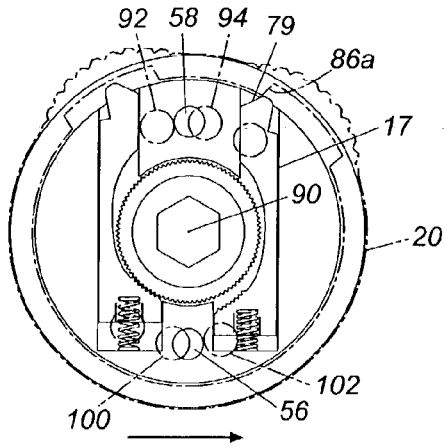
FIG. 3B is a top sectional view of the ratcheting tool as in FIG. 2B.

Referring to FIG. 3B, cover 20 is shown after the operator rotates the cover slightly counterclockwise from its position in FIG. 3A. Pin 58 and pin 56 are shown moving out of bores 92 and 102 toward bores 94 and 100. Furthermore, slider face 79 on pawl 17 begins to engage cavity sidewall 86*a* in thumb grip 86. At FIG. 3C, the user has rotated cover 20 to a predetermined position where bores 94 and 100 receive the pins. In this configuration, pawl ends 70 and 71 each enter the cavities defined in the cover by the thumb grips, thereby causing both sets of pawl teeth 64 and 65 to engage socket ring teeth 72. Consequently, socket ring 18 is rotationally fixed to handle 12 in both the clockwise and counterclockwise directions, and driver 10 applies torque to the work piece in both directions, similarly to a conventional screwdriver.

Figure 3C:
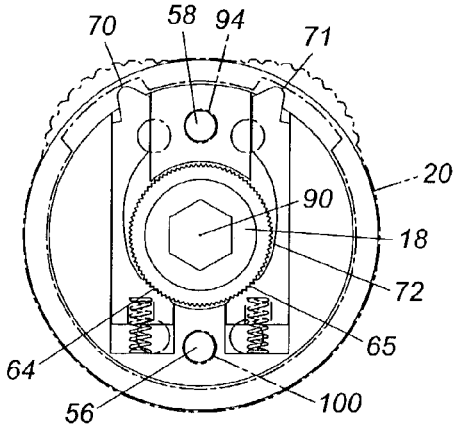
FIG. 3C is a top sectional view of the ratcheting tool as in FIG. 2B.
Figure 3D:
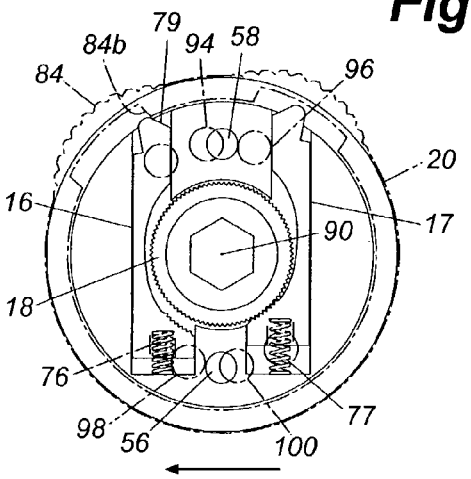
FIG. 3D is a top sectional view of the ratcheting tool as in FIG. 2B.
Figure 3E:
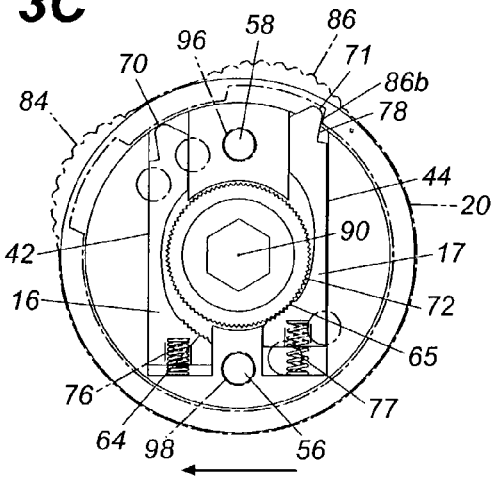
FIG. 3E is a top sectional view of the ratcheting tool as in FIG. 2B.
Figure 4A:
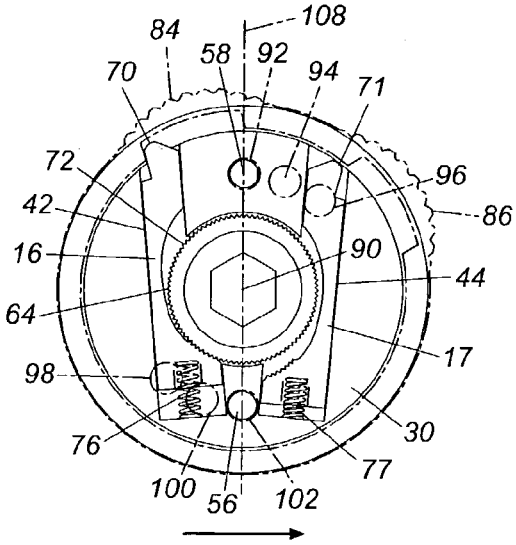
FIG. 4A is a top sectional view of a ratcheting tool as in FIG. 2A.
Figure 4B:
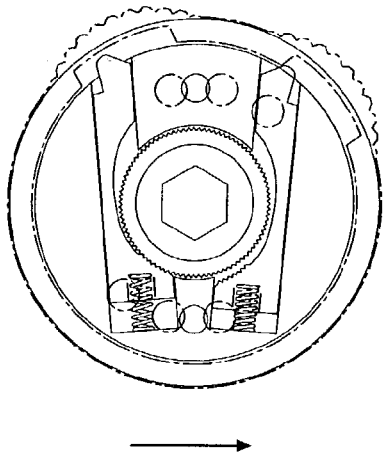
FIG. 4B is a top sectional view of a ratcheting tool as in FIG. 2A.
Figure 4C:
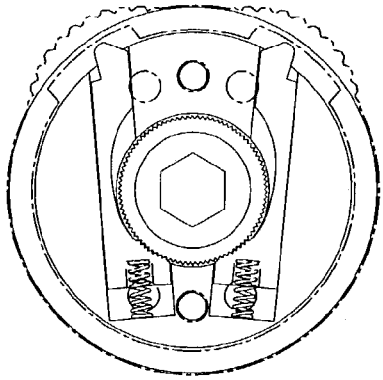
FIG. 4C is a top sectional view of the ratcheting tool as in FIG. 2A.
Figure 4D:
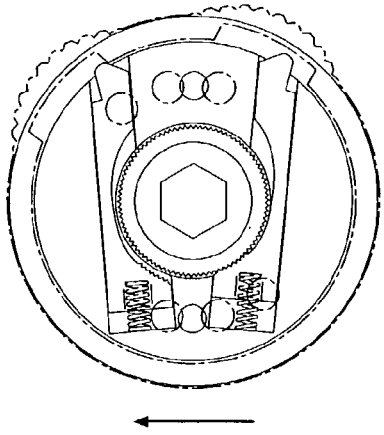
FIG. 4D is a top sectional view of the ratcheting tool as in FIG. 2A.
Figure 4E:
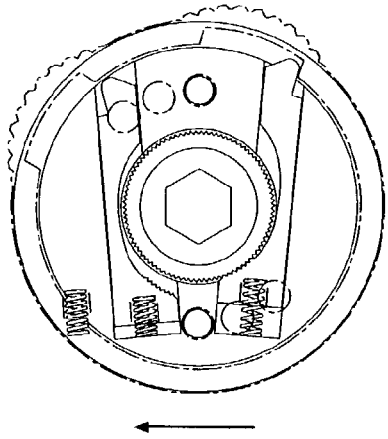
FIG. 4E is a top sectional view of the ratcheting tool as in FIG. 2A.
Figure 5A:
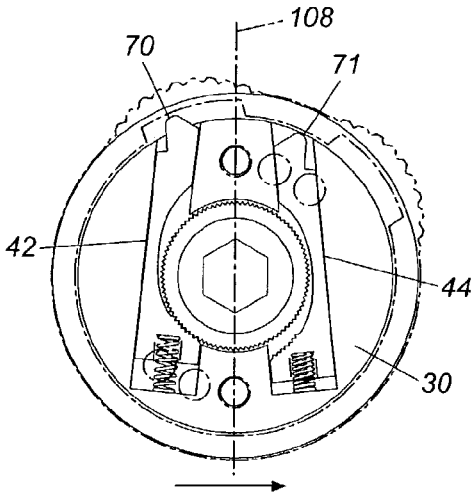
FIG. 5A is a top sectional view of the ratcheting tool as in FIG. 2C.
Figure 5B:
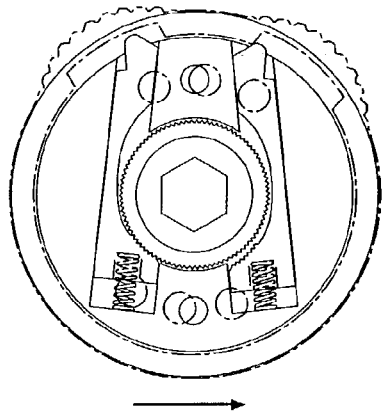
FIG. 5B is a top sectional view of the ratcheting tool as in FIG. 2C.
Figure 5C:
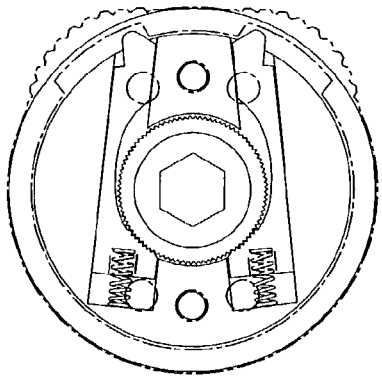
FIG. 5C is a top sectional view of the ratcheting tool as in FIG. 2C
Figure 5D:
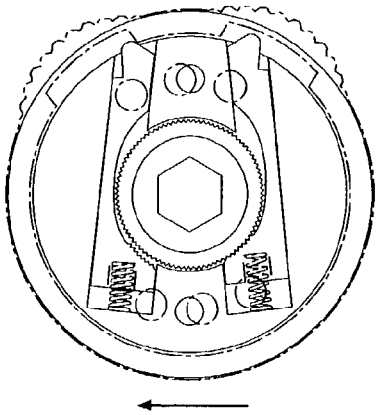
FIG. 5D is a top sectional view of the ratcheting tool as in FIG. 2C.
Figure 5E:
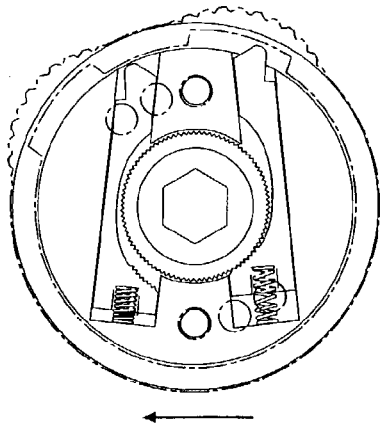
FIG. 5E is a top sectional view of the ratcheting tool as in FIG. 2C.

FIG. 3D shows the rotation of cover 20 counterclockwise from its position in FIG. 3C toward the position shown in FIG. 3E. As cover 20 is rotated, sidewall 84*b* of the cavity in thumb grip 84 engages slider face 79, thereby biasing pawl 16 downward against the upward bias of spring 76 and disengaging pawl 16 from socket ring 18. Further rotation of cover 20 to the position shown in FIG. 3E causes bores 96 and 98 to receive pins 58 and 56, respectively. Spring 77 biases pawl 17 upward so that pawl end 71 is received in the cavity formed by thumb grip portion 86 and pawl teeth 65 engage socket ring teeth 72. The cam surface between thumb grips 84 and 86 cams pawl 16 against the force of spring 76 so that pawl teeth 64 are disengaged from socket ring teeth 72. Stopper face 78 of pawl 17 engages the sidewall wall 86*b* of the cavity in thumb grip 86, thereby stopping cover 20 from over-rotating in the counterclockwise direction. That is, the stopper face on each pawl provides a mechanism to minimize over-rotation of cover 20. Therefore, it should be understood that stopper face 78 of pawl 16 stops cover 20 from being over-rotated in the clockwise direction as cover 20 is rotated clockwise into the position in shown FIG. 3A.

When a user applies torque to handle 12 in the clockwise direction (FIG. 3E) while socket ring 18 is rotationally fixed to a work piece, socket ring teeth 72 apply a counterclockwise reaction force to pawl teeth 65. This wedges the pawl between the socket ring and the back surface of pawl chamber 44, and torque is thereby applied to the work piece in the clockwise direction from body 14 through the pawl and the socket ring. If, however, the user rotates handle 12 in the counterclockwise direction, and socket ring 18 is rotationally fixed to the work piece, the reaction force against pawl teeth 65 causes pawl 17 to push against the bias of spring 77. This compresses spring 77, and pawl teeth 65 eventually ride over socket ring teeth 72. Spring 77 once again pushes pawl 17 upward, thereby forcing pawl teeth 65 back into the next set of socket ring teeth. This ratcheting process repeats as the operator continues to rotate handle 12 in the counterclockwise direction.

FIGS. 4A to 4E illustrate another embodiment of driver 10 in which each recessed chamber 42 and 44 is formed in ratchet body 30 at an angle θ (FIG. 2A) from a plane 108 that includes the driver's center line 90 so that the pawl ends 70 and 71 diverge from each other. In one presently preferred embodiment, angle θ is 5°, although it should be understood that angle θ may vary, preferably within a range of 0° to 10°. FIGS. 5A to 5E disclose yet another embodiment in which recessed chambers 42 and 44 are formed in ratchet body 30 at a 5° angle θ (FIG. 2C) from plane 108 so that the pawl ends 70 and 71 converge toward each other. As with the embodiment shown in FIGS. 4A–4E, it should be understood that the angle of convergence may vary, for example between 0° and 10°. The operation of the embodiments shown in FIGS. 4A to 4E and 5A to 5E are the same as that described above for FIGS. 3A to 3E.

Alternate embodiments of ratcheting screwdriver 10 are shown in FIGS. 7A–7C, 8A–8C, 9A–9C and 10A–10C wherein the structure of these embodiments is similar to that of ratcheting screwdriver 10, primarily except for the pawls, cover and recessed chambers. Therefore, the following discussion focuses only on the structural differences from that shown in FIGS. 1 to 6.

FIG. 7A–7C disclose a ratcheting screwdriver 210 having an annular body portion 238, pawls 216 and 217, and socket ring 218. Annular body portion 238 defines an axial bore that is adapted to receive socket ring 218. A front face 246 of annular portion 238 defines two recessed chambers 242 and 244 that receive pawls 216 and 217, respectively. Front face 246 also defines a chamber 245 that is transverse to chambers 242 and 244 and that receives a slidable lever 247. The recessed chambers are recessed from and open into front face 246 and are generally rectangular in shape, but it should be understood that the chambers may be formed in other shapes corresponding to the shape of pawls 216 and 217 and lever 247. Chambers 242 and 244 are each closed at one end but open into chamber 245 at the other end, and chamber 245 is open at both ends to allow lever 247 to slide therethrough. Chambers 242 and 244 may be parallel to one another, or they may diverge or converge at an angle θ as described in the embodiment shown in FIGS. 2A to 2C.

Pawls 216 and 217 are received by chambers 242 and 244, respectively, and each are biased toward their respective chambers' open ends by springs 248. Each of pawl 216 and 217 includes a slider edge 250 and a stopper edge 252 that engage lever 247. Pawls 216 and 217 define respective teeth 266 and 268 that engage teeth 270 formed on the outer periphery of socket ring 218.

Lever 247 includes two notched areas that form cavities 254 and 256. Cavities 254 and 256 define respective vertical walls 258 and 260 and respective angled walls 262 and 264 that engage the sliding and stopping edges of the pawls. An annular cover 220, similar to that of cover 20 (FIG. 1), fits over annular body portion 238. The annular cover differs from cover 20 in that it does not rotate relative to annular body portion 238, nor does it have finger grip portions. Instead, the cover is rotationally fixed relative to annular body portion 238 and has two open areas 222 and 224 through which the ends of lever 247 pass. This configuration allows a user to push lever 247 to the left or right into one of three predetermined positions.

In FIG. 7A, the user moves lever 247 to the left until stopper edge 252 of pawl 216 engages vertical wall 258. Thus, the stopper wall stops the lever from being pushed too far to the left. Angled wall 264 cams pawl 217 downward against the outward bias of spring 248, and pawl teeth 268 disengage from socket ring teeth 270. Additionally, cavity 254 receives sliding and stopper edges 250 and 252 of pawl 216, and pawl teeth 266 engage socket ring teeth 270. Accordingly, when a user applies torque to the handle in the counterclockwise direction while the socket ring is rotationally fixed to a work piece, socket ring teeth 270 apply a clockwise reaction force to pawl teeth 266. This wedges the pawl between the socket ring and the back surface of pawl chamber 242, and torque is thereby applied to the work piece in the counterclockwise direction. Rotation of the handle in the clockwise direction causes pawl teeth 266 to ratchet over socket ring teeth 270.

FIG. 7B shows another predetermined position in which cavities 254 and 256 receive respective slider and stopper edges 250 and 252 of each pawl. In this configuration, pawl teeth 266 and 268 engage socket ring teeth 270 to rotationally fix the socket ring relative to the ratcheting screwdriver handle. That is, rotation of the handle in either direction rotates the tool in the corresponding direction, and no ratcheting occurs.

As shown in FIG. 7C, when the user moves lever 247 to the far right (the last predetermined position), angled wall 264 cams slider edge 250 of pawl 216 downward against the upward bias of spring 248 so that pawl teeth 266 disengage from socket ring teeth 270, cavity 256 fully receives sliding and stopper edges 250 and 252 of pawl 217, and pawl teeth 268 engage socket ring teeth 270. Accordingly, when a user applies torque to the handle in the clockwise direction while the socket ring is rotationally fixed to a workpiece, socket ring teeth 270 apply a counterclockwise reaction force to pawl teeth 268. This wedges the pawl between the socket ring and the back surface of pawl chamber 244, and torque is thereby applied to the work piece in the clockwise direction. Rotation of the handle in the counterclockwise direction causes pawl teeth 268 to ratchet over socket ring teeth 270.

The embodiment of FIGS. 8A–8C is similar to that of FIGS. 7A–7C, primarily except that a lever 347 is curved and travels along an annular path. A recessed chamber 345 in the cover is annularly shaped, and its ends terminate into the open ends of recessed chambers 342 and 344. Chambers 342 and 344 may be parallel to one another, or they may diverge or converge at an angle θ as described in the embodiment shown in FIGS. 2A to 2C.

Like annular cover 220, an annular cover 320 is rotationally fixed relative to an annular body portion 338. However, the ends of lever 347 do not pass through openings formed in the wall of cover 320. Instead, annular cover 320 includes an annular slit 322 that receives a finger tab 372 therethrough. Finger tab 372 allows a user to move lever 347 to one of three predetermined positions.

Pawls 316 and 317 are received in respective chambers 342 and 344 and are biased outward toward the open ends of the chambers by springs 348. Each pawl has a slider edge 350 that interacts with a respective end of lever 347 so that the pawls can be cammed downward against the upward bias of their respective springs. That is, as the lever is moved from left to right, the lever ends interact with pawls 316 and 317 to move them up or down in their respective chambers so their teeth engage or disengage from socket ring teeth 370.

In a first predetermined position shown in FIG. 8A, the user moves lever 347 to the left so that the left end of the lever engages slider edge 350 of pawl 316, pushing the pawl downward against the upward bias of spring 348. Pawl teeth 366 disengage from socket ring teeth 370, and pawl 317 moves upward in chamber 344 so that pawl teeth 368 engage socket ring teeth 370. In this configuration, when a user applies torque to the handle in the clockwise direction while the socket ring is rotationally fixed to a work piece, socket ring teeth 370 apply a counterclockwise reaction force to pawl teeth 368. This wedges the pawl between the socket ring and the back surface of pawl chamber 344, and torque is thereby applied to the work piece in the clockwise direction. Rotation of the handle in the counterclockwise direction causes pawl teeth 368 to ratchet over socket ring teeth 370.

FIG. 8B shows a second predetermined position in which the user moves lever 347 into a central position whereby pawl teeth 366 and 368 engage socket ring teeth 370 to rotationally fix the socket ring relative to the ratcheting screwdriver handle. That is, rotation of the handle in either direction rotates the tool in the corresponding direction and no ratcheting occurs.

As shown in FIG. 8C, when the user moves lever 347 to the far right to a third predetermined position, the right side of lever 347 engages slider edge 350 of pawl 317 and pushes the pawl downward against the upward bias of its spring 348. In this position, pawl teeth 368 disengage from socket ring teeth 370, and pawl teeth 366 are allowed to engage the socket ring teeth. Consequently, when a user applies torque to the handle in the counterclockwise direction while the socket ring is rotationally fixed to a work piece, socket ring teeth 370 apply a clockwise reaction force to pawl teeth 366. This wedges the pawl between the socket ring and the back surface of pawl chamber 342, and torque is thereby applied to the work piece in the counterclockwise direction. Rotation of the handle in the clockwise direction causes pawl teeth 366 to ratchet over socket ring teeth 370.

Figure 9C:
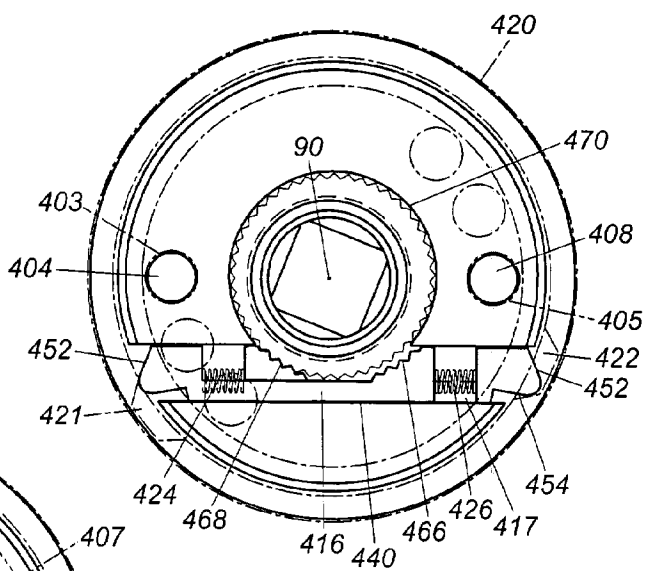
Figure 9D:
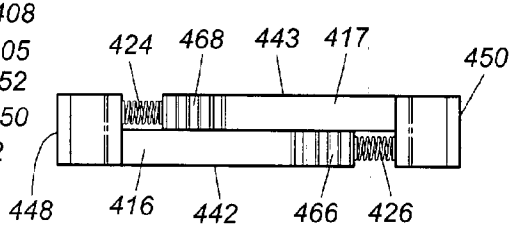
Figure 9B:
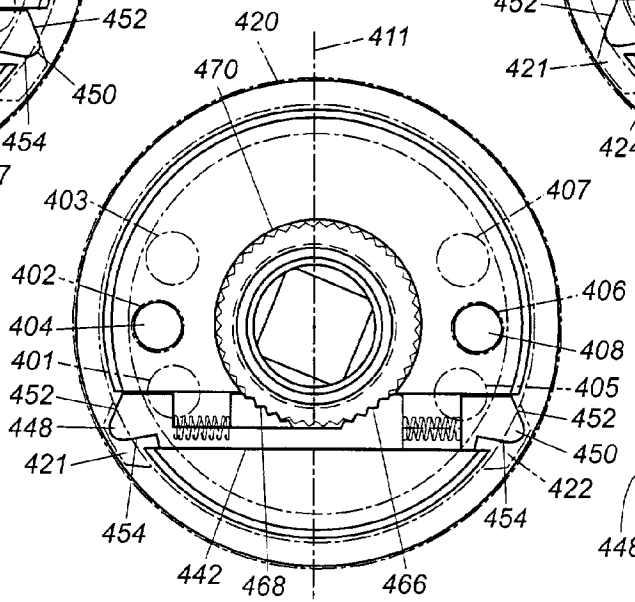
Figure 9A:
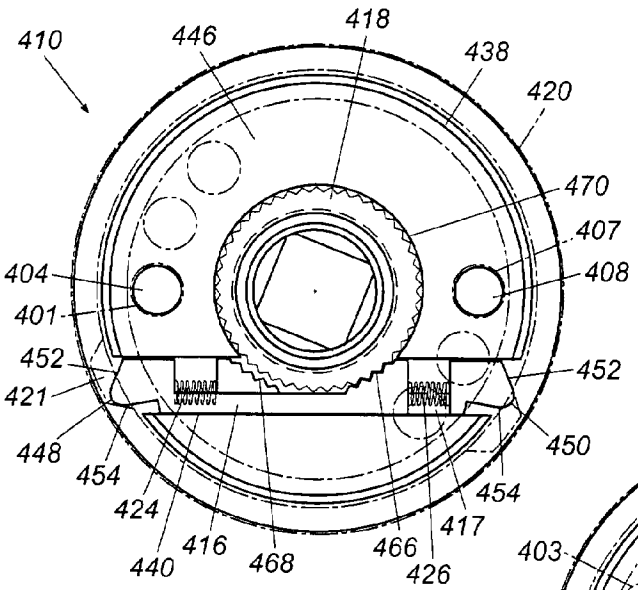

FIGS. 9A–9C show a ratcheting screwdriver 410 having an annular body portion 438, pawls 416 and 417, and a socket ring 418. Annular body portion 438 defines an axial bore that is adapted to receive socket ring 418. A front face 446 of annular body portion 438 defines a single recessed chamber 440 that receives both pawls 416 and 417. The recessed chamber is recessed from and opens into front face 446, and the chamber is open at both ends. Chamber 440 is generally rectangular in shape but may also be formed in other shapes corresponding to the shape of pawls 416 and 417.

Pawls 416 and 417 are placed into chamber 440 so that pawl 416 is stacked on top of pawl 417 (FIG. 9D) and pawls 416 and 417 slide relative to to each other and chamber 440. Each of pawls 416 and 417 is formed with respective (1) generally flat body portions 442 and 443, (2) pawl ends 448 and 450 that are wider than the main portions of the pawls so that they offset laterally from the main portions, and (3) teeth 466 and 468. When pawl 416 is placed on top of pawl 417, the end of pawl 416 at teeth 466 opposes the offset pawl end 450. The same is true for the end of pawl 417 at teeth 468 and offset pawl end 448, and pawl teeth 466 and 468 are spaced apart from each other so that they are positioned on opposite sides of socket ring 418. Springs 424 and 426 are disposed between respective offset pawl ends 448 and 450 and the opposing ends of the other pawl. The springs bias the pawls in the radially outward direction from recessed chamber 440 so that their respective teeth are biased to engage socket ring teeth 470.

Pawl ends 448 and 450 each has a respective slider edge 452 and stopper edge 454 that interact with a respective cavity 421 and 422 formed in an annular cover 420. Depending on whether one or both pawl ends 448 and 450 engage respective cavities 421 and 422, one or both sets of teeth engage socket ring teeth 470.

Referring to FIG. 9B, annular cover 420 is similar to cover 20 (FIG. 1), except that the cavities are repositioned to interact with pawl ends 448 and 450. The widths of cavities 421 and 422 are such that there are three angular positions of cover 420. In a first position of the cover, pawl end 448 enters cavity 421 while the inner circumference of annular cover 420 cams pawl end 450. In the cover's second position, cavities 421 and 422 receive respective pawl ends 448 and 450. In the cover's third position, cavity 422 receives pawl end 450 while the inner circumference of annular cover 420 cams pawl end 448. The cavities are preferably disposed symmetrically about a vertical line 411 so that the top end wall of each cavity is proximate the slider edge of each pawl when the cover is in the second position described above.

In order to maintain annular cover 420 in one of three predetermined positions, a detent mechanism similar to that described in the embodiment of FIGS. 1–6A may be used. That is, a spring and ball detent may be disposed in a blind bore in annular body portion 438, and annular cover 420 may contain a plurality of blind bores for receiving the detent. As shown in FIG. 9B, two sets of three blind bores 401/402/403 and 405/406/407 formed in the underside of cover 420 engage respective pins 404 and 408 when cover 420 is rotated with respect to the body about longitudinal axis 90. Thus, as the annular cover is rotated, the pins engage one of the plurality of bores in each respective set.

In operation, a user moves cover 420 clockwise until stopper edge 454 of pawl 416 engages the side wall of cavity 421, as shown in FIG. 9A. That is, the stopper wall stops the cover from being over-rotated in the clockwise direction. In this configuration, pins 404 and 408 respectively engage blind bores 401 and 407. The inner circumference of cover 420 cams pawl 417 to the left against the outward bias of springs 424 and 426 so that pawl teeth 468 disengage from socket ring teeth 470. Sliding and stopper edges 452 and 454 of pawl 416, however, are received into cavity 421 so that pawl teeth 466 engage socket ring teeth 470. Accordingly, when a user applies torque to the handle in the clockwise direction while the socket ring is rotationally fixed to a work piece, socket ring teeth 470 apply a counterclockwise reaction force to pawl teeth 466. This wedges the pawl between the socket ring and the back surface of pawl chamber 440, and torque is thereby applied to the work piece in the clockwise direction. Rotation of the handle in the counterclockwise direction causes pawl teeth 466 to ratchet over socket ring teeth 470.

Referring to FIG. 9B, the cover is rotated counterclockwise to its second position so that slider and stopper edges 452 and 454 of each pawl are respectively received in cavities 421 and 422. In this position, pins 404 and 408 are received in respective blind bores 402 and 406. Accordingly, pawl teeth 466 and 468 engage socket ring teeth 470 to rotationally fix the socket ring relative to the ratcheting screwdriver handle. That is, rotation of the handle in either direction rotates the tool in the corresponding direction, and no ratcheting occurs.

As shown in FIG. 9C, when the user rotates annular cover 420 counterclockwise to its third predetermined position, pins 404 and 408 engage respective blind bores 403 and 405. The inner circumference of annular cover 420 cams slider edge 452 of pawl 416 radially inward against the bias of springs 424 and 426 so that pawl teeth 466 disengage from socket ring teeth 470. Cavity 422 receives sliding and stopper edges 452 and 454 of pawl 417, and pawl teeth 468 engage socket ring teeth 470. Accordingly, when a user applies torque to the handle in the counterclockwise direction while the socket ring is rotationally fixed to a workpiece, socket ring teeth 470 apply a clockwise reaction force to pawl teeth 468. This wedges the pawl between the socket ring and the back surface of pawl chamber 440, and torque is thereby applied to the work piece in the counterclockwise direction. Rotation of the handle in the clockwise direction causes pawl teeth 468 to ratchet over socket ring teeth 470.

The embodiment shown in FIGS. 10A–10C is similar to that shown in FIGS. 1–6A, except that the open ends of the chambers are located at opposite sides of annular body portion 538. That is, chamber 542 is open at the top end, and chamber 544 is open at the bottom end (with respect to the view shown in the figures). Additionally, the finger portions on the annular cover and cavities located therein are relocated to accommodate the new chamber configuration. Ratcheting screwdriver 510 is otherwise constructed and operates similarly to ratcheting screwdriver 10, as described above with respect to FIGS. 1–6A.

The two cavities 521 and 522 are offset 180 degrees from each other and are angularly offset from a plane 511 that includes the tool's center line and that is between and parallel to chambers 542 and 544. In the cover's position shown in FIG. 10B, cavities 521 and 522 respectively receive the two pawl ends 548 and 550. If the cover is rotated to the position shown in FIG. 10A, pawl end 548 enters cavity 521, while the inner circumference of annular cover 520 cams pawl end 550. If the cover is rotated to the position shown in FIG. 10C, cavity 522 receives pawl end 550, while the inner circumference of annular cover 520 cams pawl end 548.

Referring to FIG. 10B, front face 546 of annular portion 538 includes two blind bores that receive respective sets of springs (not shown) and pins 504 and 508. Annular cover 520 defines respective sets of blind bores 501/502/503 and 505/506/507 that receive pins 504 and 508, respectively. Thus, pins 504 and 508 and respective blind bore sets 501/502/503 and 505/506/507 allow annular cover 520 to be rotationally locked in one of the three predetermined positions.

In the cover's first position, shown in FIG. 10A, spring 525 biases pawl 517 downward so that pawl teeth 568 engage socket ring teeth 570. The inner circumference of annular cover 520 cams pawl end 548 downward so that teeth 566 disengage from the socket ring teeth. Therefore, ratcheting screwdriver 510 drives a workpiece in the counterclockwise direction and ratchets in the clockwise direction. In the cover's second position, shown in FIG. 10B, pawl teeth 566 and 568 both engage socket ring teeth 570. In the cover's third position, shown in FIG. 10C, spring 524 biases pawl 516 upward so that teeth 566 engage socket ring teeth 570. The inner circumference of annular cover 520 cams pawl end 550 upward so that teeth 568 disengage from the socket ring teeth. Accordingly, ratcheting screwdriver 510 drives a workpiece in the clockwise direction and ratchets in the counterclockwise direction.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

The invention claimed is:

1. A ratcheting tool driver, said ratcheting tool driver comprising:

a. a hand-actuatable body comprising
a first axial bore having a central longitudinal axis,
an end face transverse to said first axial bore, and
a first chamber recessed from and opening into said end face and said first axial bore, said first chamber extending longitudinally transverse to said central longitudinal axis on opposite sides of said first axial bore;

b. a socket ring disposed in, and rotatable about the axis of, said first axial bore, said socket ring defining teeth about an outer circumference thereof and defining a second axial bore that receives a tool shank in rotational driving engagement therein; and c. a second chamber recessed from and opening into said end face and said first axial bore, said second chamber being located on an opposite side of said first axial bore from said first chamber, said second chamber extending longitudinally transverse to said central longitudinal axis on opposite sides of said first axial bore, and d. a first pawl having a first end defining at least one pawl tooth and an opposite second end, wherein said first pawl is disposed in said first chamber so that said first pawl first end is received on one side of said first axial bore and said first pawl second end is received on an opposite side of said first axial bore, wherein said first pawl is slidable transversely to said first axial bore between a first pawl first position in which said at least one first pawl tooth engages said socket ring teeth so that said first pawl blocks relative rotation between said body and said socket ring in a first rotational direction, and

2 first pawl second position in which said at least one first pawl tooth is disengaged from said socket ring teeth, e. a second pawl having a first end defining at least one pawl tooth and an opposite second end, wherein said second pawl is disposed in said second chamber so that said second pawl first end is received on one side of said first axial bore and said second pawl second end is received on an opposite side of said first axial bore, wherein said second pawl is slidable transversely to said first axial bore between a second pawl first position in which said at least one second pawl tooth engages said socket ring teeth so that said second pawl blocks relative rotation between said body and said socket ring in a second rotational direction opposite said first rotational direction, and a second pawl second position in which said at least one second pawl tooth is disengaged from said socket ring teeth, wherein said first pawl is biased toward said first pawl first position wherein said second pawl is biased toward said second pawl first position.

2. The tool driver as in claim 1, wherein said first chamber and said second chamber are elongated and parallel to each other.

3. The tool driver as in claim 1, wherein said first chamber and said second chamber are elongated and disposed at the same acute angle with respect to a plane between said first chamber and said second chamber that includes the central axis of said axial bore.

4. The tool driver as in claim 3, wherein said acute angle is above zero degrees and less than or equal to ten degrees.

5. The tool driver as in claim 4, wherein said acute angle is five degrees.

6. The tool driver as in claim 1, further comprising a cam attached to and selectively movable with respect to said body into engagement with said first pawl to move said first pawl to said first pawl second position and out of engagement with said first pawl to move said first pawl to said first pawl first position.

7. The tool driver as in claim 6, wherein said cam is a hand-actuable annular cover defining a cam surface on an inner circumference thereof, and wherein said cover is disposed on said body so that said cover is rotatable about said body between a first cam position in which said cam surface engages said first pawl so that said first pawl is in said first pawl second position, and a second cam position in which said cam surface disengages said first pawl so that said first pawl is in said first pawl first position.

8. The tool driver as in claim 6, further comprising a detent defined between said cam and said body and retaining said cam respectively in said first cam position and said second cam position.

9. The tool driver as in claim 1, further comprising a cam attached to and selectively movable with respect to said body into a first cam position in which said cam engages said first pawl so that said first pawl is in said first pawl second position and releases said second pawl into said second pawl first position, a second cam position in which said cam engages said second pawl so that said second pawl is in said second pawl second position and releases said first pawl into said first pawl first position, and a third cam position in which said cam releases each of said first pawl and said second pawl to said first pawl first position and said second pawl first position so that said first pawl and said second pawl block relative rotation between said body and said socket ring in said first and said second rotational directions.

10. The tool driver as in claim 9, further comprising a detent defined between said cam and said body, wherein said detent retains said cam respectively in said first cam position, said second cam position and said third cam position.

11. A ratcheting tool driver, said ratcheting tool driver comprising:

a. a hand-actuatable body comprising a first axial bore having a central longitudinal axis, an end face transverse to said first axial bore, and a first chamber recessed from and opening into said end face and said first axial bore, said first chamber extending longitudinally transverse to said central longitudinal axis on opposite sides of said first axial bore, a second chamber recessed from and opening into said end face and said first axial bore, said second chamber being located on an opposite side of said first axial bore from said first chamber, said second chamber extending longitudinally transverse to said central longitudinal axis on opposite sides of said first axial bore;

b. a socket ring disposed in, and rotatable about the axis of, said first axial bore, said socket ring defining teeth about an outer circumference thereof and defining a second axial bore that receives a tool shank in rotationally driving engagement therein;

c. a first pawl having a first end defining a plurality of teeth and an opposite second end, wherein said first pawl is disposed in said first chamber so that said first pawl first end is received on one side of said first axial bore and said first pawl second end is received on an opposite side of said first axial bore, wherein said first pawl is slidable between a first pawl first position in which said first pawl teeth engage said socket ring teeth so that said first pawl blocks relative rotation between said body and said socket ring in a first rotational direction, and a first pawl second position in which said first pawl teeth are disengaged from said socket ring teeth; and d. a second pawl having a first end defining a plurality of teeth and an opposite second end, wherein said second pawl is disposed in said second chamber so that said second pawl first end is received on one side of said first axial bore and said second pawl second end is received on an opposite side of said first axial bore, wherein said second pawl is slidable between a second pawl first position in which said second pawl teeth engage said socket ring teeth so that said second pawl blocks relative rotation between said body and said socket ring in a second rotational direction opposite said first rotational direction, and a second pawl second position in which said second pawl teeth are disengaged from said socket ring teeth.

12. The tool driver as in claim 11, further comprising:

a. a first spring disposed between a wall of said first recessed chamber and said first pawl so that said first spring biases said first pawl toward said first pawl first position; and b. a second spring disposed between a wall of said second recessed chamber and said second pawl so that said second spring biases said second pawl toward said second pawl first position.

13. The tool driver as in claim 12, further comprising a cam coupled to and selectively movable with respect to said body between a first cam position in which said cam engages said first pawl so that said first pawl is in said first pawl second position and releases said second pawl into said second pawl first position, a second cam position in which said cam engages said second pawl so that said second pawl is in said second pawl second position and releases said first pawl into said first pawl first position, and a third cam position in which said cam releases each of said first pawl and said second pawl so that respective pawls move to said first pawl first position and said second pawl first position so that said first pawl and said second pawl block relative rotation between said body and said socket ring in said first and said second rotational directions.

14. The tool driver as in claim 13, further comprising a detent defined between said cam and said body and retaining said cam respectively in said first cam position, said second cam position and said third cam position.

15. The tool driver as in claim 14, wherein said cam is a hand-actuable annular cover defining a cam surface on an inner circumference thereof, and wherein said cover is disposed on said body so that said cover is rotatable about said body between said first cam position, said second cam position and said third cam position.

16. The tool driver as in claim 15, wherein said detent comprises:

a. a first blind bore formed in said end face parallel to said first axial bore;

b. a plurality of blind bores formed in a bottom surface of said annular cover; and c. a spring and a ball disposed in said first blind bore so that said spring biases said ball out of said first blind bore and into engagement with one of said plurality of blind bores.

17. A ratcheting tool driver, said ratcheting tool driver comprising:

a. a hand-actuatable body comprising a first axial bore having a central longitudinal axis, an end face transverse to said first axial bore, and a first chamber recessed from and opening into said end face and said first axial bore, said first chamber extending longitudinally transverse to said central longitudinal axis on opposite sides of said first axial bore;

b. a handle axially and rotatably fixed to said body;

c. a socket ring disposed in, and rotatable about the axis of, said first axial bore, said socket ring defining teeth about an outer circumference thereof and defining a second axial bore that receives a tool shank in rotationally driving engagement therein;

d. a first pawl having a first end defining at least one pawl tooth and an opposite second end, wherein said first pawl is disposed in said first chamber so that said first pawl first end is received on one side of said first axial bore and said first pawl second end is received on an opposite side of said first axial bore, wherein said first pawl is slidable transversely to said first axial bore between a first pawl first position in which said at least one first pawl tooth engages said socket ring teeth so that said first pawl blocks relative rotation between said body and said socket ring in a first rotational direction, and a first pawl second position in which said at least one first pawl tooth is disengaged from said socket ring teeth, wherein said first pawl is biased toward said first pawl first position;

e. a second chamber recessed from and opening into said end face and said first axial bore, said second chamber being located on an opposite side of said first axial bore from said first chamber, said second chamber extending longitudinally transverse to said central longitudinal axis on opposite sides of said first axial bore, and f. a second pawl having a first end defining at least one pawl tooth and an opposite second end, wherein said second pawl is disposed in said second chamber so that said second pawl first end is received on one side of said first axial bore and said second pawl second end is received on an opposite side of said first axial bore, wherein said first pawl is slidable transversely to said first axial bore between a second pawl first position in which said at least one second pawl tooth engages said socket ring teeth so that said second pawl blocks relative rotation between said body and said socket ring in a second rotational direction opposite said first rotational direction, and a second pawl second position in which said at least one second pawl tooth is disengaged from said socket ring teeth, wherein said second pawl is biased toward said second pawl first position.

18. The tool driver as in claim 17, further comprising:

a. a first spring disposed between a wall of said first recessed chamber and said first pawl so that said first spring biases said first pawl toward said first pawl first position; and b. a second spring disposed between a wall of said second recessed chamber and said second pawl so that said second spring biases said second pawl toward said second pawl first position.

19. The tool driver as in claim 18, further comprising a cam coupled to and selectively movable with respect to said body into a first cam position in which said cam engages said first pawl so that said first pawl is in said first pawl second position and releases said second pawl into said second pawl first position, and a second cam position in which said cam engages said second pawl so that said second pawl is in said second pawl second position and releases said first pawl into said first pawl first position.

20. The tool driver as in claim 19, wherein said cam is a hand-actuable annular cover defining a cam surface on an inner circumference thereof, and wherein said cover is disposed on said body so that said cover is rotatable about said body between said first cam position and said second cam position.

21. The tool driver as in claim 20, further comprising a detent defined between said cam and said body and retaining said cam respectively in said first cam position and said second cam position.

22. The tool driver as in claim 21, wherein said detent comprises:

a. a first blind bore formed in said end face parallel to said first axial bore;

b. a plurality of blind bores formed in a bottom surface of said annular cover; and c. a spring and a ball disposed in said first blind bore so that said spring biased said ball out of said first blind bore, wherein said ball engages one of said plurality of blind bores.

23. A ratcheting tool driver, said ratcheting tool driver comprising:

a. a hand-actuatable body comprising an end face;

b. a socket ring disposed in, and rotatable about an axis of, said hand actuable body, said socket ring defining teeth about an outer circumference thereof and defining an axial bore that receives a tool shank in rotational driving engagement therein;

c. a first chamber recessed from and opening into said end face, said first chamber extending longitudinally transverse to hand actuable body axis on opposite sides of said axial bore;

d. a second chamber recessed from and opening into said end face, said second chamber being positioned on an opposite side of said socket ring from said first chamber, said second chamber extending longitudinally transverse to hand actuable body axis on opposite sides of said axial bore, e. a first pawl having a first end defining at least one pawl tooth and an opposite second end, wherein said first pawl is disposed in said first chamber so that said first pawl first end is received on one side of said axial bore and said first pawl second end is received on an opposite side of said axial bore, wherein said first pawl is slidable between a first pawl first position in which said at least one first pawl tooth engages said socket ring teeth so that said first pawl blocks relative rotation between said body and said socket ring in a first rotational direction, and a first pawl second position in which said at least one first pawl tooth is disengaged from said socket ring teeth, and f. a second pawl having a first end defining at least one pawl tooth and an opposite second end, wherein said second pawl is disposed in said second chamber so that said second pawl first end is received on one side of said axial bore and said second pawl second end is received on an opposite side of said axial bore, wherein said pawl is slidable between a second pawl first position in which said at least one second pawl tooth engages said socket ring teeth so that said second pawl blocks relative rotation between said body and said socket ring in a second rotational direction opposite said first rotational direction, and a second pawl second position in which said at least one second pawl tooth is disengaged from said socket ring teeth, wherein said first pawl is biased toward said first pawl first position wherein said second pawl is biased toward said second pawl first position.

24. The tool driver as in claim 23, wherein said first chamber and said second chamber are elongated and parallel to each other.

25. The tool driver as in claim 23, wherein said first chamber and said second chamber are elongated and disposed at the same acute angle with respect to a plane between said first chamber and said second chamber that includes the central axis of said axial bore.

26. The tool driver as in claim 25, wherein said acute angle is above zero degrees and less than or equal to ten degrees.

27. The tool driver as in claim 26, wherein said acute angle is five degrees.

28. The tool driver as in claim 23, further comprising a cam attached to and selectively movable with respect to said body into engagement with said first pawl to move said first pawl to said first pawl second position and out of engagement with said first pawl to move said first pawl to said first pawl first position.

29. The tool driver as in claim 28, wherein said cam is a hand-actuable annular cover defining a cam surface on an inner circumference thereof, and wherein said cover is disposed on said body so that said cover is rotatable about said body between a first cam position in which said cam surface engages said first pawl so that said first pawl is in said first pawl second position, and a second cam position in which said cam surface disengages said first pawl so that said first pawl is in said first pawl first position.

30. The tool driver as in claim 28, further comprising a detent defined between said cam and said body and retaining said cam respectively in said first cam position and said second cam position.

31. The tool driver as in claim 23, further comprising a cam attached to and selectively movable with respect to said body between a first cam position in which said cam engages said first pawl so that said first pawl is in said first pawl second position and releases said second pawl into said second pawl first position, a second cam position in which said cam engages said second pawl so that said second pawl is in said second pawl second position and releases said first pawl into said first pawl first position, and a third cam position in which said cam releases each of said first pawl and said second pawl to said first pawl first position and said second pawl first position so that said first pawl and said second pawl block relative rotation between said body and said socket ring in said first and said second rotational directions.

32. The tool driver as in claim 31, further comprising a detent defined between said cam and said body, wherein said detent retains said cam respectively in said first cam position, said second cam position and said third cam position.

* * * * *

UNITED STATES PATENT AND TRADEMARK OFFICE

CERTIFICATE OF CORRECTION

PATENT NO. : 7,137,320 B2
APPLICATION NO. : 10/360180
DATED : November 21, 2006
INVENTOR(S) : Tuan-Mu It is certified that error appears in the above-identified patent and that said Letters Patent is hereby corrected as shown below:

Delete title page, and replace with new title page. (attached)

Delete drawing sheets 1 and 6, and replace with new drawing sheets 1 and 6.

Signed and Sealed this
Twenty-fourth Day of July, 2012

David J. Kappos

David J. Kappos
*Director of the United States Patent and Trademark Office*

(12) United States Patent
Tuan-Mu

(10) Patent No.: US 7,137,320 B2
(45) Date of Patent: Nov. 21, 2006

(54) RATCHETING TOOL DRIVER

(75) Inventor: Hsien-Chung Tuan-Mu, Taichung (TW)

(73) Assignee: Easco Hand Tools, Inc., Simsbury, CT (US)

( * ) Notice: Subject to any disclaimer, the term of this patent is extended or adjusted under 35 U.S.C. 154(b) by 0 days.

(21) Appl. No.: 10/360,180

(22) Filed: Feb. 7, 2003

(65) Prior Publication Data

US 2004/0154439 A1 Aug. 12, 2004

(51) Int. Cl.
*B25B 13/46* (2006.01)
*B25B 15/04* (2006.01)

(52) U.S. Cl. ..... 81/63.1; 81/58.4; 192/43.2

(58) Field of Classification Search ..... 81/60–63.1, 81/58.4; 192/43.1, 43.2, 44, 45, 43.44
See application file for complete search history.

(56) References Cited

U.S. PATENT DOCUMENTS

| | | | | |
|---|---|---|---|---|
| 791,895 | A | 6/1905 | Purbish | |
| 1,493,353 | A | 5/1924 | Leopold | |
| 2,627,330 | A | 2/1953 | Gantz | |
| 2,720,296 | A | 10/1955 | Briglia | |
| 3,342,229 | A | 9/1967 | Janes | |
| 3,356,117 | A | 12/1967 | Wagner | |
| 3,783,703 | A | 1/1974 | Trimble et al. | |
| 4,290,328 | A | 9/1981 | Clark | |
| 4,735,120 | A | 4/1988 | Beugelsdyk | |
| 5,437,212 | A | 8/1995 | Thomson et al. | |
| 5,520,073 | A | 5/1996 | Bakula et al. | |
| 5,535,648 | A * | 7/1996 | Braun et al. | 81/63.1 |
| 5,570,616 | A | 11/1996 | Thompson et al. | |
| 5,575,192 | A | 11/1996 | Eggert | |
| 5,685,204 | A * | 11/1997 | Braun | 81/63.1 |
| 5,687,820 | A * | 11/1997 | Lin | 81/63.1 |
| 5,711,193 | A | 1/1998 | Eggert | |
| 5,974,915 | A * | 11/1999 | Chou | 81/63.1 |
| 5,988,337 | A * | 11/1999 | Liu | 192/43.1 |
| 6,047,802 | A * | 4/2000 | Huang | 192/43.2 |
| 6,227,077 | B1 | 5/2001 | Chiang | |
| 6,250,183 | B1 | 6/2001 | Chiang | |
| 6,370,988 | B1 | 4/2002 | Thompson et al. | |
| 6,644,147 | B1 * | 11/2003 | Huang | 81/62 |

FOREIGN PATENT DOCUMENTS

| | | |
|---|---|---|
| DE | 9208547 | 10/1992 |
| DE | 9318291 | 4/1994 |
| GB | 2145359 | 3/1985 |

* cited by examiner

*Primary Examiner*—Hadi Shakeri
(74) *Attorney, Agent, or Firm*—Nelson Mullins Riley & Scarborough, L.L.P.

(57) ABSTRACT

A ratcheting tool driver has a handle and a ratcheting body that includes a plurality of recesses for receiving a plurality of pawls having teeth formed thereon. A cover is axially secured to the ratcheting body and rotates relative to the body over a limited distance. The cover is formed so that it interacts with the plurality of pawls, which are operatively received in the body recesses so that they engage and disengage teeth formed on a socket ring. The socket ring contains a plurality of teeth on its outer circumference, is received in an axial bore formed in the ratcheting body, and operatively engages the pawl teeth.

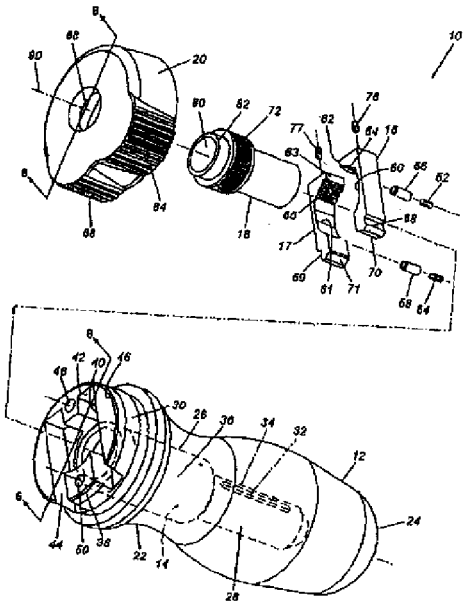

32 Claims, 10 Drawing Sheets